United States Patent [19]

Hirasawa et al.

[11] Patent Number: 4,750,534

[45] Date of Patent: Jun. 14, 1988

[54] APPARATUS FOR FILLING A FILM CASING WITH FLUID MATERIAL

[75] Inventors: Noboru Hirasawa, Tokyo; Kiyomi Seya, Matsudo; Zenya Kato, Tokyo, all of Japan

[73] Assignee: Kureha Chemical Industry Company Limited, Tokyo, Japan

[21] Appl. No.: 40,363

[22] Filed: Apr. 17, 1987

[30] Foreign Application Priority Data

Apr. 30, 1986 [JP] Japan ..... 61-99904

[51] Int. Cl.[4] ..... B65B 31/00; B65B 9/06

[52] U.S. Cl. ..... 141/114; 53/511; 53/551; 141/59; 141/73

[58] Field of Search ..... 141/5, 6, 7, 10, 12, 141/37, 54, 59, 65, 71, 73, 114, 285, 290, 301, 310; 53/511, 551, 552, 433, 451; 17/41

[56] References Cited

U.S. PATENT DOCUMENTS

| | | | |
|---|---|---|---|
| 990,547 | 4/1911 | Gunuskey | 17/41 |
| 2,387,812 | 10/1945 | Sonneborn et al. | 53/511 X |
| 2,815,621 | 12/1957 | Carter | 141/114 X |
| 3,040,490 | 6/1962 | Virta | 53/551 X |
| 3,325,961 | 6/1967 | Lindh et al. | 53/551 X |
| 3,381,441 | 5/1968 | Condo, Jr. et al. | 53/551 X |
| 3,384,134 | 5/1968 | Itillerns | 141/10 |
| 3,488,915 | 1/1970 | Delestatius | 53/511 |
| 3,611,657 | 10/1971 | Inoue et al. | 53/551 X |
| 3,853,999 | 12/1974 | Kentor | 141/114 X |
| 4,054,161 | 10/1977 | Alack | 141/12 |
| 4,640,083 | 7/1987 | Takahashi et al. | 53/551 |
| 4,641,486 | 2/1987 | Zannoni | 53/433 |

*Primary Examiner*—Henry J. Recla
*Assistant Examiner*—Ernest G. Cusick
*Attorney, Agent, or Firm*—Koda and Androlia

[57] ABSTRACT

A stuffer nozzle of a double pipe type is inserted in a cylindrical member formed by joining opposite ends of a film. Fluid material such as raw egg is supplied from an inner pipe of the stuffer nozzle to fill the cylindrical member with the fluid material. An air valve communicating with an outer pipe of the stuffer nozzle is opened to exhaust air in the cylindrical member and reduce pressure in the cylindrical member in synchronism with a timing that a pair of squeezing rollers squeeze the cylindrical member filled with the fluid material. The squeezed cylindrical member is clamped by a clamping member. The air vent valve is closed to prevent air from entering into the cylindrical member from outside through the outer pipe of the stuffer nozzle in synchronism with a timing that the squeezing rollers are separated from the cylindrical member.

4 Claims, 6 Drawing Sheets

APPARATUS FOR FILLING A FILM CASING WITH FLUID MATERIAL

BACKGROUND OF THE INVENTION

1. Field of the Invention

The present invention relates to an apparatus for filling a film casing with fluid material such as raw egg separated into white and yolk, and more particularly to such a filling apparatus capable of preventing air from entering into the film casing.

2. Prior Art

Egg used a raw material for sandwiches is separated into white and yolk and is filled in a film casing 1 shown in FIG. 8 so that the egg filled in the film casing 1 is supplied in a food processing factory. The film casing 1 is formed into a cylinder by joining the opposite ends of a film made of, for example, vinylidene chloride resin at a seal portion of joined portion 1*a*. Raw egg is then filled into the cylinder and thereafter both ends of the cylinder filled with raw egg are clamped by clamping members 2 such as aluminum wires. Raw egg is then heated at it is filled in the film casing so that white or yolk of raw egg in the casing is hardened and then forwarded to the food processing factory. The film casing is then removed from egg in the food processing factory and egg is used as material for sandwiches.

When fluid material such as egg is filled into the film casing 1, there is a problem that air enters into the film casing 1 during the filling operation. Air entered into the film casing 1 comes to the surface of the film casing as an air bubble. Accordingly, when the filled material is white or yolk of egg, a portion of the filled egg where the air bubble exists is discolored to brown when it is heated. Since the discolored portion can be seen through the film casing, the value of the filled egg is reduced. Accordingly, when raw egg or the like is filled into the film casing, it is necessary to prevent air from entering into the film casing.

In a conventional filling operation of egg for preventing the entrance of air, only one end of a cylinder 40*a* formed of a film is clamped by a clamping member 2 as shown in FIG. 9 and raw egg is filled into the cylinder 40*a* from a filling nozzle. The cylinder 40*a* filled with egg is then set upright in a container 3 shown in FIG. 9 with the other end of the cylinder 40*a* opened and air is exhausted from the cylinder 40*a*. After air has been exhausted from the cylinder, the open end of the cylinder is closed tight to prevent the entrance of air and is clamped by a clamping member 2 to complete the casing 1.

However, in the above conventional operation, many processes must be made by hand and therefore the operation efficiency is very wrong.

Accordingly, it is desired to develop an apparatus which automatically fills the film casing 1 with fluid material such as egg without entrance of air. Heretofore, as an apparatus which automatically fills a cylindrical film casing with material, there has been developed an automatic filling apparatus which fills a cylindrical film casing with processed meat to manufacture sausage as shown in FIG. 10. The automatic filling apparatus is continuously fed with film 40 made of vinylidene chloride resin to roll it in a cylinder by a forming member 4 and joins the opposite ends of the rolled film by high-frequency electrodes 5*a* and 5*b* to form a cylindrical member 40*a*. Filling material such as processed meat is filled into the cylinder member 40*a* from a stuffer nozzle 6. A pair of squeezing rollers 7*a* and 7*b* are disposed under the stuffer nozzle 6 to squeeze ends of the cylindrical member 40*a* and the squeezed ends are clamped by a clamping member 2 formed of for example, aluminum wire. When the end of the cylindrical member 40*a* is squeezed by the rollers 7*a* and 7*b*, the pressure in the cylindrical member 40*a* is increased. However, the increase of the pressure can be adjusted by upward movement of an adjustment ring 8 slidably disposed around the stuffer nozzle 6.

However, since the conventional automatic filling apparatus as shown in FIG. 10 is used to fill the cylindrical member 40*a* with the material such as the processed meat which is not fluid and has a tendency that air is hard to enter into the cylindrical member together with the material, the apparatus is not quite provided with function for exhausting air from the cylindrical member 40*a*. Accordingly, when the apparatus is employed as a filling apparatus of fluid material such as egg as it is, much air enters into the film casing 1. Further, when the conventional automatic filling apparatus is used to fill the film casing with the fluid material, the fluid material flows out upwardly from a gap between the adjustment ring 8 and the inner surface of the film 40.

SUMMARY OF THE INVENTION

It is an object of the present invention to provide an apparatus for automatically filling a film casing with fluid material such as raw egg separated into white and yolk.

It is another object of the present invention to provide an apparatus for filling a film casing with fluid material which can adjust properly increase of pressure in the film casing produced when the film casing is squeezed by squeezing rollers and can exhaust air in the film casing together with the adjustment of the pressure effectively.

DETAILED DESCRIPTION OF THE INVENTION

A filling apparatus of fluid material shown in figures automatically and continuously fills a film casing 1 with fluid material having a certain degree of viscosity such as raw egg separated into white and yolk and resembling liquid material as compared with processed meat.

Figure 1:
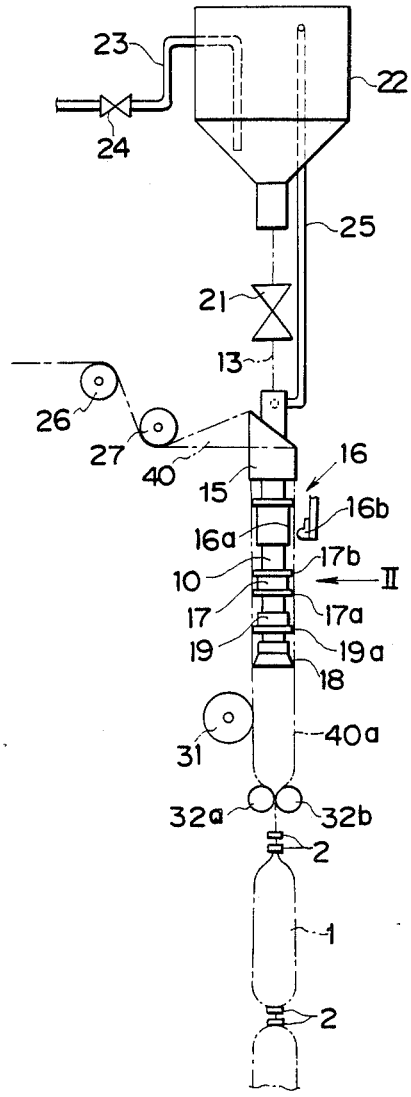
FIG. 1 is a side view of an apparatus for filling a film casing with fluid material.
Figure 2:
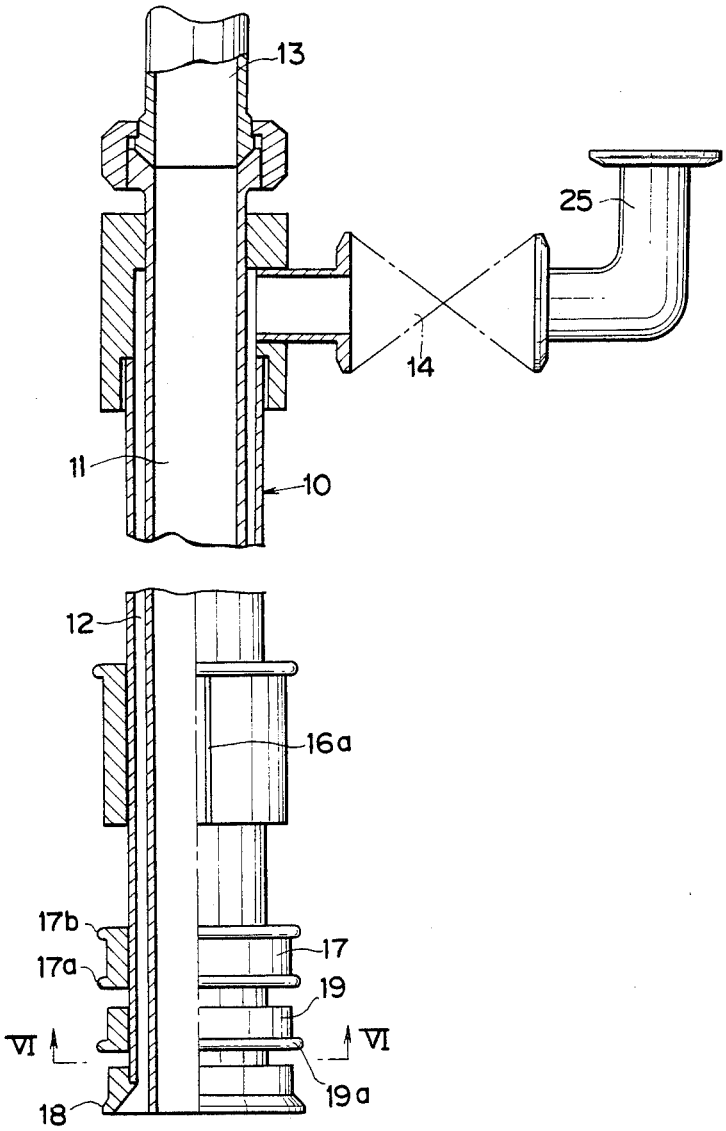
FIG. 2 is a partially sectional side view of the filling apparatus as viewed from arrow II of FIG. 1.

As shown in FIG. 2, stuffer nozzle 10 is formed of a double pipe including an inner pipe forming a filling nozzle 11 for feeding fluid material and an outer pipe forming an air vent nozzle 12. A top end of the filling nozzle 11 is connected to a connection pipe 13 and a top end of the pipe 13 is connected through a valve 21 to a hopper 22. A supply pipe 23 is connected to the hopper 22 and fluid material such as raw egg is fed in the hopper 22 from the supply pipe 23. A valve 24 is provided in the way of the pipe 23 and is opened and closed in accordance with a quantity of the fluid material in the hopper 22 to supplement the fluid material into the hopper 22. Further, as shown in FIG. 2, a top end of the air vent nozzle 12 forming the outer pipe of the stuffer nozzle 10 is connected through an air vent valve 14 to an air vent pipe 25. As shown in FIG. 1, a top end of the air vent pipe 25 is opened in an upper portion of the hopper 22.

A forming member 15 is disposed around the upper portion of the stuffer nozzle 10. A film 40 made of vinylidene chloride is fed through film supply rollers 26 and 27 and is formed into a cylinder by the forming member 15. Disposed below the forming member 15 is also a joining device 16 which is formed of a pair of opposite high-frequency electrodes **16*a* and 16*b*. The opposite ends of the cylindrical film 40 formed by the forming member 16 are joined by the high-frequency electrodes 16*a* and 16*b* to form a cylindrical member 40*a* made of a film. A lower end of the stuffer nozzle 10 is inserted in the cylindrical member 40*a***.

Upper and lower size rings 17 and 18 are fixedly mounted around the stuffer nozzle 10. The outer diameter of the flanges **17*a* and 17*b* formed at the upper and lower ends of the upper size ring 17 and the outer diameter of the lower size ring 18 are formed slightly larger than the inner diameter of the cylindrical member 40*a* of the film formed by forming member 15 and the flanges 17*a* and 17*b* and the lower size ring 18 are adapted to slidably move in the cylindrical member 40*a* without a gap therebetween. Accordingly, when the cylindrical member 40*a* is filled with the fluid material from the stuffer nozzle 10, the outer peripheries of the upper and lower size rings 17 and 18** prevent the fluid material from overflowing upward.

Figure 6:
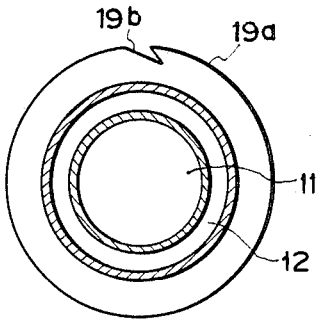
FIG. 6 is a sectional view taken along line VI—VI of FIG. 2 and showing a ring for removing air bubbles.

An air bubble removing ring 19 is disposed between the upper and lower size rings 17 and 18. The air bubble removing ring 19 is provided with a flange **19*a* and the diameter of the flange 19*a* is formed slightly smaller than the diameter of the size rings 17 and 18 so that a small gap is formed between the outer periphery of the flange 19*a* and the cylindrical member 40*a*. As shown in FIG. 6, a notch 19*b* is formed aslant in an outer periphery of the flange 19*a* of the air bubble removing ring 19. As shown in an enlarged sectional view of FIG. 7, a narrow outer end piece 40*b* disposed outside the cylindrical member 40*a* formed by joining the opposite ends of the film 40 by the joining device 16 and a narrow inner end piece 40*c* disposed inside the cylindrical member 40*a* are left on both sides of the joined portion or seal portion 1*a* of the cylindrical member 40*a*. The inner end piece 40*c* is guided in the notch 19*b* of the ring 19 and the inner end piece 40*c* is forcedly separated from the inner surface of the cylindrical member 40*a*. The filled fluid material is slightly exuded from the lower size ring 18 upward, while the exuded fluid material is forced to flow between the end piece 40*c* and the cylindrical member 40*a* so that air bubbles can be prevented from remaining between the end piece 40*c* and the inner surface of the cylindrical member 40*a***.

A film advancing roller 31 is disposed below the stuffer nozzle 10 (see FIG. 1). The cylindrical member **40*a* of film is advanced downward by the film advancing roller 31** at a constant speed.

Figure 3:
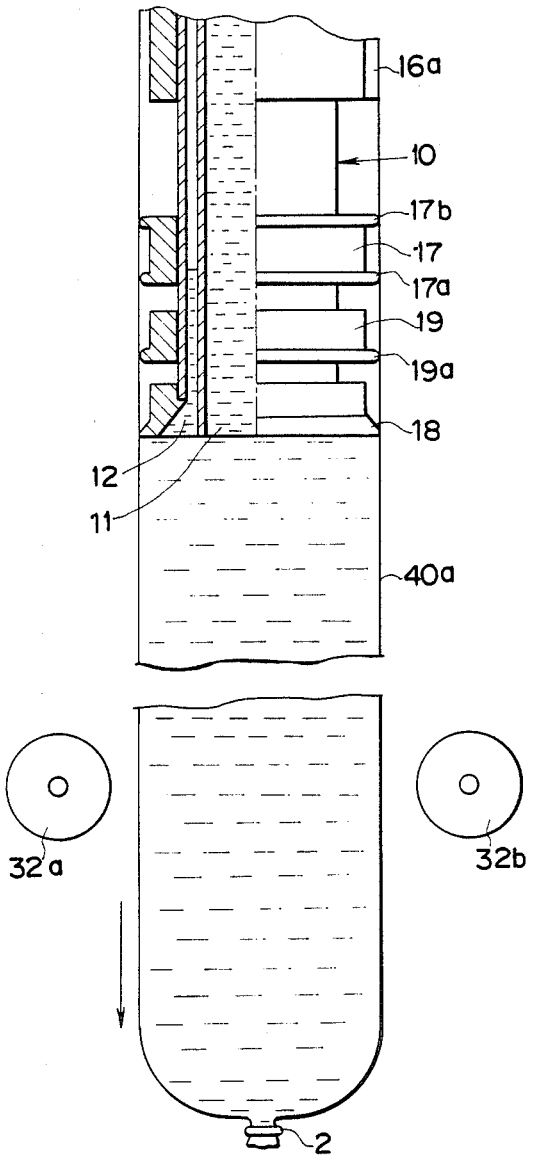
FIG. 3 is a partially sectional enlarged front view of the filling apparatus showing an operation of filling the film casing with fluid material.
Figure 4:
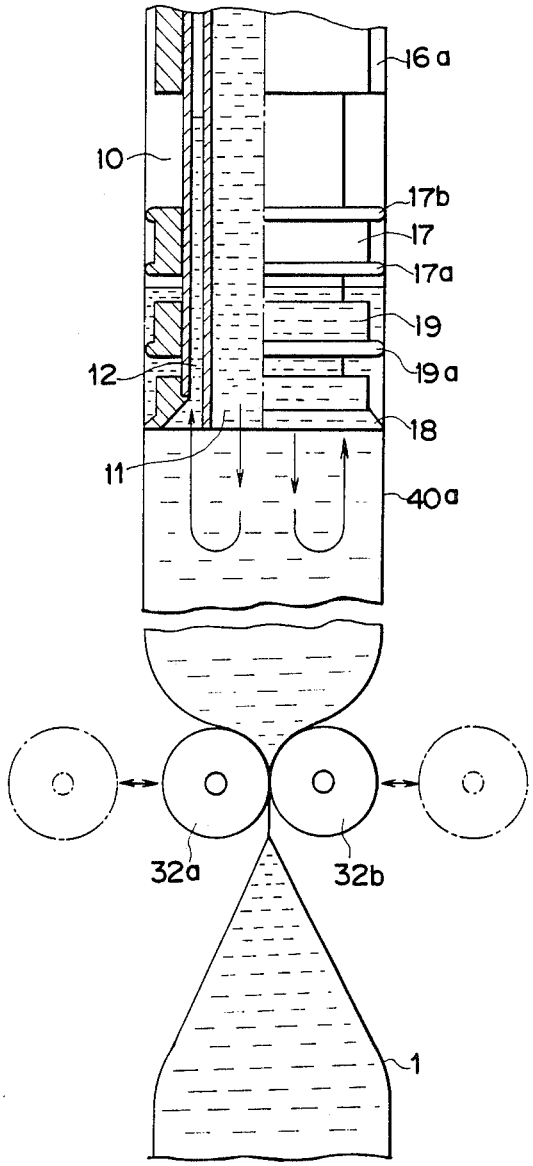
FIG. 4 is a partially sectional enlarged front view of the filling apparatus showing an operation of filling the film casing with fluid material.

A pair of squeezing rollers **32*a* and 32*b* are disposed below the film advancing roller 31. The pair of squeezing rollers 32*a* and 32*b* are opposite to each other so that the cylindrical member 40*a* formed of the film is put between the squeezing rollers 32*a* and 32*b* and is squeezed by the rollers. The squeezing rollers 32*a* and 32*b* are moved between a first position in which the rollers are brought into contact with each other to squeeze the cylindrical member 40*a* as shown in FIG. 4 and a second position in which the rollers 32*a* and 32*b* are apart from each other as shown in FIG. 3. One squeezing roller 32*a* is rotated in synchronism with the film advancing roller 31** to advance the squeezed film downward.

A clamping mechanism is further provided below the pair of squeezing rollers **32*a* and 32*b*. The film squeezed by the squeezing rollers 32*a* and 32*b* is clamped with clamping members 2** of aluminum wire by the clamping mechanism.

Operation is now described.

The fluid material such as white or yolk of raw egg is fed into the hopper 22 from the supply pipe 23 shown in FIG. 1. At this time, the quantity of the fluid material in the hopper 22 is adjusted by the opening and closing of the valve 24.

The film 40 of vinylidene chloride resin is continuously fed by the film supply rollers 26 and 27 and is formed into a cylinder by the forming member 15. The opposite ends of the cylinder are joined to each other by the electrodes **16*a* and 16*b* of the joining device 16 to form the cylindrical member 40*a***.

When the valve 21 disposed below the hopper 22 is opened, the fluid material in the hopper 22 falls into the inner filling nozzle 11 of the stuffer nozzle 10 by the weight of the material. The fluid material is filed into the cylindrical film member **40*a* by the pressure corresponding to a head of the fluid material in the hopper 22. During the filling operation, the pair of squeezing rollers 32*a* and 32*b* are apart from each other as shown in FIG. 3 and the cylindrical member 40*a* is continuously advanced downward between the rollers 32*a* and 32*b* by the film advancing roller 31 at the constant speed. When a predetermined quantity of fluid material is filled into the cylindrical member 40*a* including the lower end thereof clamped by the clamping member 2, that is, when the position of the clamping member 2 attached to the lower end of the cylindrical member 40*a* to prevent the fluid material from flowing out of the cylindrical member downward is lowered by a predetermined distance, the pair of squeezing rollers 32*a* and 32*b* approach to each other to squeeze the cylindrical member 40*a* from both sides thereof. The fluid material in the cylindrical member 40*a* is squeezed by the squeezing rollers 32*a* and 32*b*. The fluid material is filled into the cylindrical member 40*a* being lowered is interrupted by the squeezing rollers 32*a* and 32*b* and the pressure of the fluid material in the cylindrical member 40*a*** is accordingly increased rapidly in the state of FIG. 4.

Figure 5:
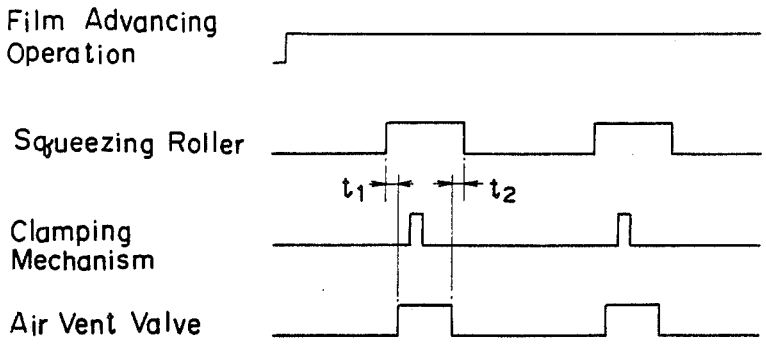
FIG. 5 is a time chart showing operation timing of squeezing rollers and an air vent valve.

As shown in FIG. 5, the air vent valve 14 shown in FIG. 2 is opened a short time $t_1$ after completion of the squeezing operation by the pair of rollers 32a and 32b and the upper end of the air vent nozzle 12 is opened. Thus, the fluid material flows into the air vent nozzle 12 to adjust the increased pressure in the cylindrical member 40a by the squeezing operation of the rollers 32a and 32b. At this time, air entered into the cylindrical member 40a together with the fluid material from the hopper 22 is exhausted through the air vent nozzles 12 and the air vent valve 14 from the air vent pipe 25. Since the outer diameter of the lower size ring 18 is formed slightly larger than the inner diameter of the cylindrical film member 40a, the size rings 17 and 18 prevent the fluid material from going up between the outside of the stuffer nozzle 10 and the cylindrical film member 40a to the position of the high-frequency electrode 16a of the joining device 16.

As shown in the time chart of FIG. 5, after the squeezing operation by the squeezing rollers 32a and 32b, the clamping member 2 such a aluminum wire is wound on the squeezed film. Consequently, one film casing 1 is formed below the squeezing rollers 32a and 32b as shown in FIG. 1.

After the completion of the clamping operation, the pair of squeezing rollers 32a and 32b are separated from each other. As shown in the time chart of FIG. 5, the air vent valve 14 is closed a short time $t_2$ before the starting time of the separation of the squeezing rollers 32a and 32b. When the squeezing rollers 32a and 32b are separated, the pressure of the fluid material in the lowering cylindrical member 40a is rapidly reduced. However, the air vent valve 14 is closed before the separation as described above to prevent air from entering into the cylindrical member 40a from the air vent pipe 25 and the air vent nozzle 12.

Figure 8:
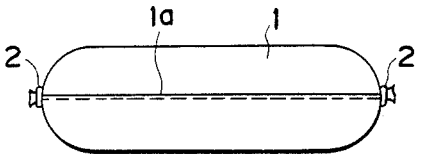
FIG. 8 Prior Art
FIG. 8 is a plan view showing a film casing filled with fluid material.
Figure 9:
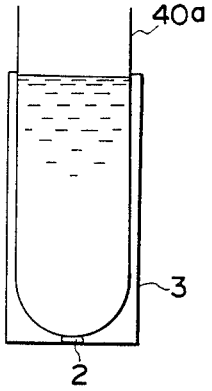
FIG. 9 Prior Art
FIG. 9 is a front view showing a conventional operation of filling a film casing with fluid material.
Figure 10:
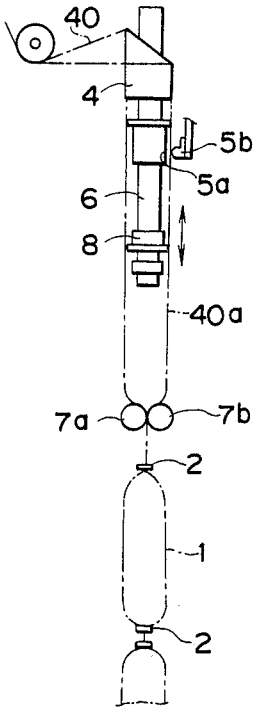
FIG. 10 Prior Art
FIG. 10 is a front view of a conventional apparatus for filling a film casing with processed meat for use in manufacture of sausage.

The above operation is repeated so that the film casings 1 of which both ends are clamped by the clamping members 2 are continuously manufactured. Each of the film casings 1 is separated at the portion where the clamping member 2 is clamped as shown in FIG. 8. In the case where the filled fluid material is raw egg, it is hardened in a heating process.

Figure 7:
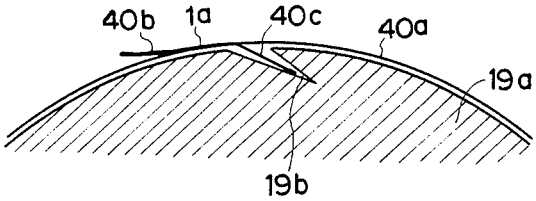
FIG. 7 is a partial enlarged view of FIG. 6.

In the filling operation, while the flanges 17a and 17b of the upper size ring 17 and the lower size ring 18 prevent the fluid material from going up along the outer periphery of the stuffer nozzle 10, the upper surface of the fluid material goes up just under the upper size ring 17 and the air bubble removing ring 19 is immersed in the fluid material as shown in FIG. 4. As shown in FIG. 7, the inner end piece 40c at the joined portion 1a of the cylindrical film member 40a is guided into the notch 19b formed in the flange 19a of the air bubble removing ring 19 and the end piece 40c is forcedly separated from the inner surface of the cylindrical member 40a. Accordingly, the opposite surfaces between the end piece 40c and the inner surface of the cylindrical member 40a forming a gap therebetween are wetted by the fluid material. Subsequently, the end piece 40c is pressed to the inner surfaces of the cylindrical member 40a by the outer periphery of the lower size ring 18. However, since the opposite surfaces between the end piece 40c and the inner surface of the cylindrical member 40a is once wetted by the fluid material, an air bubble is prevented from remaining in the gap formed by the opposite surfaces and the air bubble is also prevented from gathering under the lower size ring 18.

The fluid material is not limited to raw egg and the filling apparatus of the present invention can attain the same operation and effect as described above even if the fluid material is other fluid material which has a tendency that air enters into the cylindrical member together with the material.

A time difference in the opening and closing operation between the squeezing rollers 32a and 32b and the air vent valve 14 shown by the times $t_1$ and $t_2$ of FIG. 5 may be set in accordance with various conditions such as the viscosity of the fluid material and a sectional area of the air vent nozzle 12 forming the outer pipe of the stuffer nozzle 10. In certain cases, both or none of the times $t_1$ and $t_2$ may be reduced to zero, or the air vent valve 14 may be opened just before the squeezing operation by the rollers 32a and 32b and be closed just after separation of the rollers 32a and 32b.

As described above, according to the present invention, since the stuffer nozzle is formed of a double pipe including the inner filling nozzle and the other air vent nozzle, air entering into the cylindrical member together with the fluid material is exhausted by the other air vent nozzle effectively. Further, since the air vent valve coupling to the air vent nozzle is opened and closed in synchronism with the operation of the squeezing rollers, the increased pressure in the cylindrical film member can be adjusted by the squeezing operation of the squeezing rollers and air contained in the cylindrical member can be exhausted exactly in the squeezing operation. In addition, since air can be prevented from entering into the film casing in the case where the fluid material is raw egg, it can be prevented that egg hardened by the heating is discolored to brown due to

We claim:

1. An apparatus for filling a film casing with fluid material, including a film supply of a film, said film defining opposite ends, and a joining device for joining opposite ends of said film to form a cylindrical member having inner and outer diameters, a stuffer nozzle having upper and lower ends disposed inside the joining device and inserted into the cylindrical member, a pair of squeezing rollers disposed under the stuffer nozzle, said pair of squeezing rollers being moved between a first position in which the rollers squeeze the cylindrical member of the film and a second position in which the rollers are apart from the cylindrical member and a clamping mechanism for clamping the cylindrical member of the film squeezed by the rollers, wherein:

said stuffer nozzle is formed of a double pipe including an inner filling nozzle for feeding the fluid material into the cylindrical member and an outer air vent nozzle including an upper end communicating with an air vent valve, said air vent valve is opened in synchronism with the squeezing of the cylindrical member of the film by the squeezing rollers and is closed in synchronism with the separating from the cylindrical members of the film by the squeezing rollers.

2. An apparatus according to claim 1, wherein said air vent valve is opened just after the squeezing of the cylindrical member by the squeezing rollers and said air vent valve is closed just before separating from the cylindrical member by the squeezing rollers.

3. An apparatus according to claim 1, comprising a pair of spaced size rings provided at said lower end of the stuffer nozzle and including a diameter larger than said inner diameter of the cylindrical member formed by joining the film by the joining device.

4. An apparatus according to claim 1, further comprising a hopper for supplying fluid material to said stuffer nozzle said hopper having an upper portion and said air vent valve communicates with said upper portion of said hopper.

* * * * *